US008643687B2

(12) United States Patent
Horiuchi

(10) Patent No.: US 8,643,687 B2
(45) Date of Patent: Feb. 4, 2014

(54) PRINTING SURFACE PROCESSING METHOD AND PRINTING SURFACE PROCESSING APPARATUS

(71) Applicant: Casio Computer Co., Ltd., Tokyo (JP)

(72) Inventor: Yuji Horiuchi, Higashiyamato (JP)

(73) Assignee: Casio Computer Co., Ltd., Tokyo (JP)

( * ) Notice: Subject to any disclaimer, the term of this patent is extended or adjusted under 35 U.S.C. 154(b) by 0 days.

(21) Appl. No.: 13/784,802

(22) Filed: Mar. 4, 2013

(65) Prior Publication Data

US 2013/0229478 A1 Sep. 5, 2013

(30) Foreign Application Priority Data

Mar. 5, 2012 (JP) ..... 2012-048134

(51) Int. Cl.
*B41J 2/32* (2006.01)

(52) U.S. Cl.
USPC ..... 347/212

(58) Field of Classification Search
USPC ..... 347/171, 172, 225
See application file for complete search history.

(56) References Cited

U.S. PATENT DOCUMENTS

2013/0161874 A1* 6/2013 Horiuchi ..... 264/415
2013/0168903 A1* 7/2013 Horiuchi et al. ..... 264/413

FOREIGN PATENT DOCUMENTS

JP 2006-031688 A 2/2006

* cited by examiner

*Primary Examiner* — Huan Tran
(74) *Attorney, Agent, or Firm* — Holtz, Holtz, Goodman & Chick, PC

(57) ABSTRACT

A printing surface processing method includes first forming, second forming and applying. In the first forming, a substantially flat first image expressed with unevenness sense based on a touch and/or a stroke of a brush is formed on a first face of a thermal expansion sheet. In the second forming, a second image constituted of a grayscale image is formed on a second face of the sheet. The grayscale image includes a dark portion and a light portion with densities set to form a substantially uneven shape on the first face. The uneven shape corresponds to the unevenness sense of the first image and unevenness sense of fabric where the first image is supposed to be formed. In the applying, thermal energy is applied to the second image to expand the sheet to form the uneven shape on the first face.

10 Claims, 6 Drawing Sheets

PRINTING SURFACE PROCESSING METHOD AND PRINTING SURFACE PROCESSING APPARATUS

CROSS REFERENCE TO RELATED APPLICATION

This application is based upon and claims the benefit of priority under 35 USC 119 of Japanese Patent Application No. 2012-048134 filed on Mar. 5, 2012, the entire disclosure of which, including the description, claims, drawings, and abstract, is incorporated herein by reference in its entirety.

BACKGROUND OF THE INVENTION

1. Field of the Invention

The present invention relates to a printing surface processing method and a printing surface processing apparatus, and in particular, relates to a printing surface processing method and a printing surface processing apparatus each of which can be applied to creation of a piece with a desired painting style by editing and processing an original image.

2. Description of the Related Art

In recent years, with spread of personal computers, color printers, image editing software, Internet or the like, it has been possible to easily edit and print images at ordinary households too. Currently, by using image editing software installed in personal computers, digital cameras or the like, or by using image editing services through Internet, original images can be edited and processed to create desired pieces with various painting styles, such as an oil painting style, a watercolor painting style, a colored pencil drawing (painting) style, a pastel painting style and an airbrush painting style.

With respect to the image editing and processing technology, there is disclosed, for example, in Japanese Patent Application Laid-Open Publication No. 2006-31688 a technology to convert an image picked up by a digital camera into an image with a painting style.

However, a piece created by the image editing described above is just a painting-like image, and accordingly only a flat painting-like image (i.e. pseudo-printed material) is usually obtained. To express or reproduce such a piece with a more realistic texture, there are problems described below.

That is, for example, as a feature of oil painting, in general, paint is laid on thickly so as to make a painting three-dimensional. Hence, to create a piece with the oil painting style as a printed matter from an original image, an edited image needs to be printed on a thick printing medium having not a flat surface shape but an uneven surface shape. Household printers cannot perform the printing properly. This is because a standard is established for printing media on which the household printers can perform printing. Because of the mechanism of the household printers, if the surface shape of a printing medium is not flat or the thickness thereof is more than the thickness of the standard, a household printer often cannot print an image on a printing medium or cannot express or reproduce a desired texture. As a method to solve these problems, there is a method of scanning an image multiple times so as to lay on paint multiple times, thereby printing a three-dimensional image on a printing medium by using, for example, an inkjet printer for business, which uses ink having a high viscosity. However, it takes much time and money. Hence, this method is not something casually taken for general use.

As is the case with creation of a piece with the oil painting style, in the case of creation of a piece with the watercolor painting style, the colored pencil drawing style, the pastel painting style or the like by editing and processing an original image too, it is difficult for a household printer to express or reproduce unevenness sense of a painting style, namely, a unique texture of a painting style, such as a touch and/or a stroke of a brush thereof.

BRIEF SUMMARY OF THE INVENTION

The present invention is made in view of the circumstances, and objects of the present invention include providing a printing surface processing method and a printing surface processing apparatus each of which can express or reproduce a piece, which is created by editing and processing an original image to have a desired painting style, with a unique texture of the painting style in a simple manner.

In order to achieve at least one of the objects, according to a first aspect of the present invention, there is provided a printing surface processing method including: forming a substantially flat first printing image expressed with unevenness sense based on a touch and/or a stroke of a brush on a first face of a thermal expansion sheet in which a thermal expansion layer is formed on a first face of a base material sheet; forming a second printing image constituted of a grayscale image made of a photothermal conversion material on a second face of the thermal expansion sheet, the grayscale image including a dark portion and a light portion with densities being set to form a substantially uneven shape on the first face of the thermal expansion sheet, the substantially uneven shape corresponding to unevenness image data, in which first unevenness image data to realize the unevenness sense of the first printing image and second unevenness image data to realize unevenness sense of fabric on which the first printing image is supposed to be formed are superposed; and applying thermal energy to the second printing image to expand the thermal expansion layer to form the substantially uneven shape in accordance with the second printing image on the first face of the thermal expansion sheet.

In order to achieve at least one of the objects, according to a second aspect of the present invention, there is provided a printing surface processing apparatus including: an image processing unit which generates first printing image data expressed with unevenness sense based on a touch and/or a stroke of a brush, and generates second printing image data converted into a grayscale image including a dark portion and a light portion with densities being set to correspond to unevenness image data, in which first unevenness image data to realize the unevenness sense of the first printing image data and second unevenness image data to realize unevenness sense of fabric on which a first printing image is supposed to be formed are superposed; a printing mechanism unit which forms the first printing image on the basis of the first printing image data on a first face of a thermal expansion sheet in which a thermal expansion layer is formed on a first face of a base material sheet, and forms a second printing image on the basis of the second printing image data with a photothermal conversion material on a second face of the thermal expansion sheet; and a thermal energy application unit which applies thermal energy to the thermal expansion sheet, on the first face of which the first printing image is formed, and on the second face of which the second printing image is formed, to expand the thermal expansion layer to form a substantially uneven shape in accordance with the second printing image on the first face of the thermal expansion sheet.

BRIEF DESCRIPTION OF THE SEVERAL VIEWS OF THE DRAWINGS

A more complete understanding of this application can be obtained when the following detailed description is considered in conjunction with the following drawings, in which.

DETAILED DESCRIPTION OF THE INVENTION

In the following, a printing surface processing method and a printing surface processing apparatus of the present invention are described in detail with an embodiment.

<Printing Surface Processing Method>

First, a printing surface processing method of the present invention is described.

Figure 1:
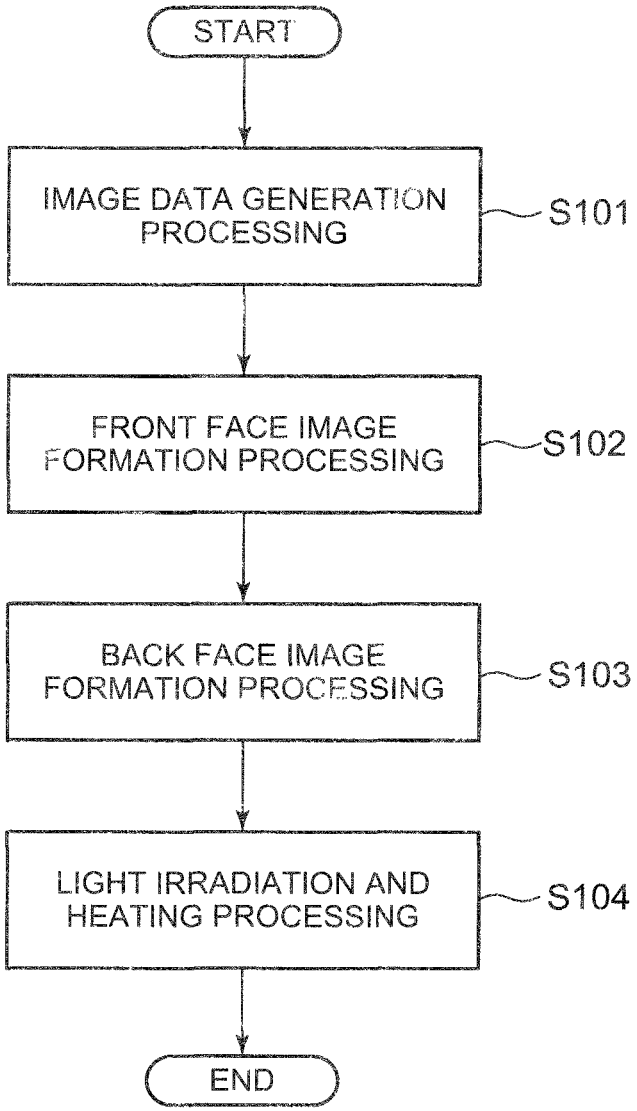
FIG. 1 is a flowchart showing an example of a printing surface processing method of the present invention.
Figure 2A:
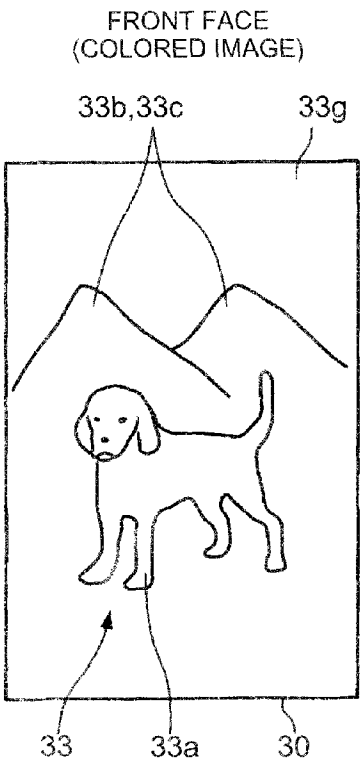
FIGS. 2A to 2C are plan views schematically showing an embodiment of the printing surface processing method of the present invention.
Figure 2B:
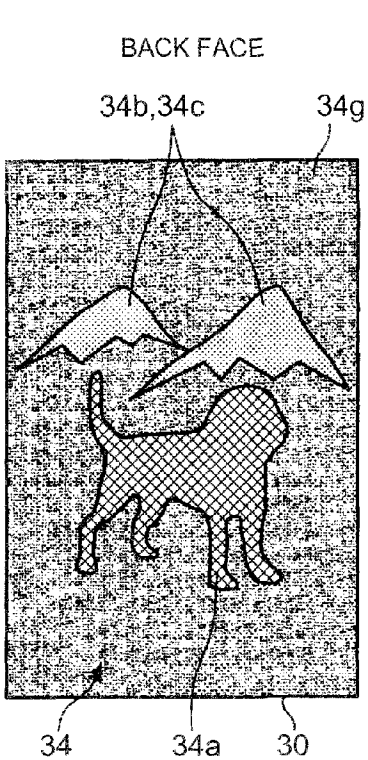
Figure 2B:
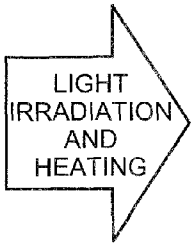
Figure 2C:
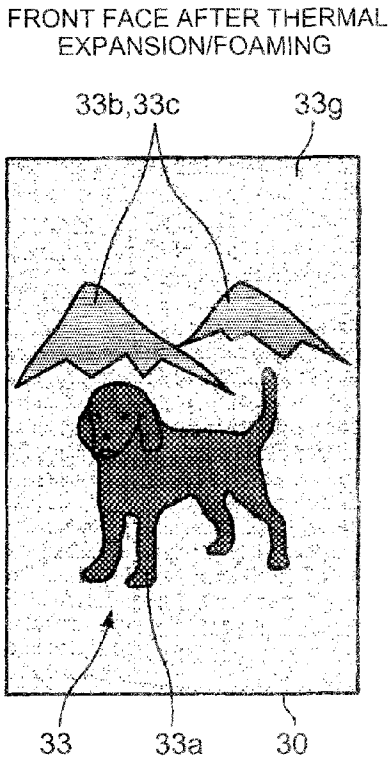
Figure 3A:
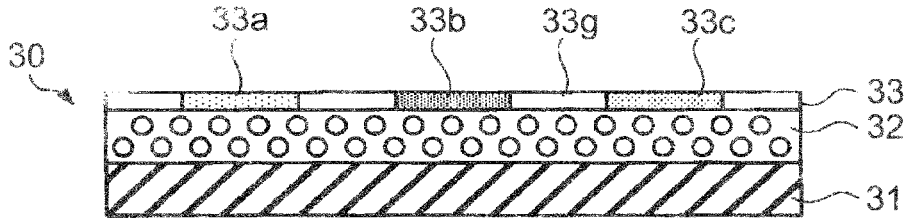
FIGS. 3A to 3D are cross-sectional views schematically showing processing states related to the embodiment of the printing surface processing method.
Figure 3B:
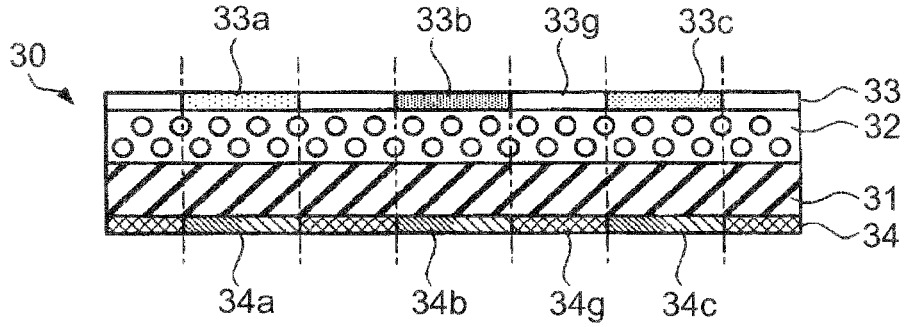

FIG. 1 is a flowchart showing an example of the printing surface processing method of the present invention. FIGS. 2A to 2C are plan views schematically showing an embodiment of the printing surface processing method of the present invention. FIGS. 3A to 3D are cross-sectional views schematically showing processing states related to the embodiment of the printing surface processing method. A specific image formed on the back face of a thermal expansion sheet shown in FIG. 2B, an uneven pattern and a touch and/or a stroke of a brush for a desired painting style formed on the front face of the thermal expansion sheet shown in FIG. 2C, and an expansion (foaming) state of a thermal expansion layer shown in FIG. 3D are expediently and conceptually shown for explanation, and do not indicate their actual conditions.

As shown in FIG. 1, the printing surface processing method includes image data generation processing (Step S101), front face image formation processing (Step S102), back face image formation processing (Step S103), and light irradiation and heating processing (Step S104). Here, with respect to the printing surface processing method, a case is described as an example, the case, as shown in FIG. 2A, in which a piece having a colored image 33, which is constituted of an image of a dog (dog image) and images of mountains (mountain images), printed on the front face of a thermal expansion sheet 30 is processed to have a texture like the piece being drawn (painted) with a plurality of kinds of surface shapes and/or a plurality of kinds of touches and/or strokes of a brush (including a pen and the like) so as to express or reproduce a desired texture.

In the image data generation processing (Step S101), first, image data (front face image data) of the colored image 33 (first printing image) and a thermal expansion sheet (or a thermal foam sheet) 30 are prepared. The image data of the colored image 33 is obtained by editing and processing an original image to have a desired painting style by using image conversion software or image conversion services. The thermal expansion sheet 30 is a printing medium on which the colored image 33 is printed. As shown in FIG. 3A, the thermal expansion sheet 30 is a printing medium constituted of a base material sheet 31 and a thermal expansion layer (or a thermal foam layer) 32, for example. The thermal expansion layer 32 includes foam microcapsules which are expanded by heat. The thermal expansion layer 32 is applied to one face (the upper face in FIG. 3A) of the base material sheet 31. The thermal expansion sheet 30, which is applied to the embodiment, has a substantially flat surface shape with respect to the one face of the thermal expansion layer 32, and has a thickness in accordance with a standard with which a general household printer can perform printing. The colored image 33 may be a color image having arbitrary designs, such as the dog image and the mountain images shown in FIG. 2A (corresponding to designs 33*a* to 33*c* shown in FIG. 3A), a monochrome image or a monotone image.

Next, a texture desired to be expressed or reproduced in a piece, which is created by forming the colored image 33 on the front face of the thermal expansion sheet 30 (the one face of the thermal expansion layer 32), is specified, and image data (back face image data or unevenness image data) of a specific image 34 (second printing image) formed on the back face of the thermal expansion sheet 30 (the lower face in FIG. 3B, namely, the other face of the base material sheet 31) for the desired texture is generated.

More specifically, in a case where, of the colored image 33 shown in FIG. 3A, the design 33*a* for the dog image and the designs 33*b* and 33*c* for the mountain images are expressed or reproduced, for example, with a touch and/or a stroke of a brush of the oil painting style drawn by laying on paint thickly, and a background image part 33*g*, which is a portion other than the portions of the designs 33*a* to 33*c*, is expressed or reproduced with a texture like the background image part 33*g* being drawn on a canvas, image data of the specific image 34 is generated in such a way that, in regions on the front face of the thermal expansion sheet 30, the regions where the designs 33*a* to 33*c* for the dog image and the mountain images are printed, uneven surface shapes, which are approximate or similar to a touch and/or a stroke of a brush of a painting style, are formed, and in a region on the front face of the thermal expansion sheet 30, the region where the background image part 33*g* is printed, a fine uneven surface shape, which is approximate or similar to a thread pattern expressing fabric of a canvas, is formed. That is, the unevenness image data is constituted of first unevenness image data to express (realize) unevenness sense of the colored image 33 and second unevenness image data to express (realize) unevenness sense of fabric where the colored image 33 is supposed to be formed, the first unevenness image data and the second unevenness image data being superposed.

A method for forming the surface shapes for the desired texture on the front face of the thermal expansion sheet 30 is as follows. As shown in FIG. 3B, for the designs 33*a* to 33*c* for the dog image and the mountain images, image regions 34*a* to 34*c* are set to correspond to uneven patterns on the front face of the thermal expansion sheet 30, the uneven patterns which express or reproduce a desired texture of a touch and/or a stroke of a brush. The image regions 34*a* to 34*c* are each constituted of a grayscale image (monochrome grayscale image), in which dark portions and light portions are arranged with densities being set (predetermined densities). In addition, for the background image part 33*g*, an image region 34*g* is set to correspond to an uneven pattern on the front face of the thermal expansion sheet 30, the uneven pattern which expresses or reproduces a texture of a canvas. The background image region 34*q* is constituted of a grayscale image, in which dark portions and light portions are arranged with predetermined densities. Then, the specific image 34 constituted of these image regions 34*a* to 34*c* and 34*g* is formed on the whole back face of the thermal expansion sheet 30, and thermal expansion processing is performed thereon, so that the surface shapes for the desired textures are formed on the front face of the thermal expansion sheet 30.

In the embodiment, a black component is not limited to a black pigment but includes a material having photothermal conversion property (photothermal conversion material) which generates thermal energy by absorbing light including a wavelength of infrared light (which broadly means a wavelength of far-infrared light too). As a photothermal conversion material, carbon black can be used, for example.

In the image data generation processing for the specific image 34, a user may be able to appropriately adjust the arrangement of the dark portions and the light portions and the predetermined densities of the image regions 34*a* to 34*c* and 34*g*, which constitute the specific image 34. Accordingly, for the designs 33*a* to 33*c* for the dog image and the mountain images, the lengths and/or fineness of the uneven patterns (for example, wave patterns or dot patterns corresponding to brushstrokes) on the front face of the thermal expansion sheet 30, the thickness of paint laid on and the like can be appropriately set. The uneven patterns express or reproduce a desired texture of a touch and/or a stroke of a brush. In addition, for the background image part 33*g*, coarseness and/or heights of raised portions of the uneven pattern (namely, a thread pattern of a canvas) on the front face of the thermal expansion sheet 30 can be appropriately set. The uneven pattern expresses or reproduces the texture of a canvas.

Next, in the front face image formation processing (Step S102), as shown in FIGS. 2A and 3A, the colored image 33 having the design 33*a* for the dog image, the designs 33*b* and 33*c* for the mountain images and the background image part 33*g* is printed (formed) on the front face of the thermal expansion sheet 30 on the basis of the image data of the colored image 33 prepared in the image data generation processing (Step S101). More specifically, as shown in FIG. 3A, on the front face of the thermal expansion sheet 30 (the one face of the base material sheet 31, namely, the upper face in FIG. 3A), the colored image 33 constituted of the dog image and the mountain images shown in FIG. 2A is printed. To print the colored image 33 on the front face of the thermal expansion sheet 30, printing apparatuses with various systems can be used, such as an inkjet system printing apparatus, a laser system printing apparatus and a thermal transfer system printing apparatus, which are described related to a printing surface processing apparatus below.

Next, in the back face image formation processing (Step S103), as shown in FIGS. 2B and 3B, the specific image 34 constituted of monochrome grayscale images is printed (formed) on the back face of the thermal expansion sheet 30 on the basis of the image data generated in the image data generation processing (Step S101). In regions corresponding to the designs 33*a* to 33*c* for the dog image and the mountain images formed on the front face of the thermal expansion sheet 30, the image regions 34*a* to 34*c*, in each of which dark portions and light portions are arranged with predetermined densities, are printed so as to express or reproduce a desired texture of a touch and/or a stroke of a brush. In addition, in a region corresponding to the background image part 33*g*, the image region 34*g*, in which dark portions and light portions are arranged with predetermined densities, printed so as to express or reproduce a texture of a canvas. To express the image regions 34*a* to 34*c* as images formed on a canvas, a desired texture of a touch and/or a stroke of a brush and the texture of a canvas may be expressed or reproduced together. The specific image 34 printed on the back face of the thermal expansion sheet 30 is a mirror image, namely, a reversed image, of the colored image 33 printed on the front face of the thermal expansion sheet 30. The specific image 34 formed on the back face of the thermal expansion sheet 30 is formed with ink or toner which includes a black component. To print the specific image 34 on the back face of the thermal expansion sheet 30 too, printing apparatuses with various systems can be used, such as an inkjet system printing apparatus, a laser system printing apparatus and a thermal transfer system printing apparatus, which are described related to a printing surface processing apparatus below.

Figure 3C:
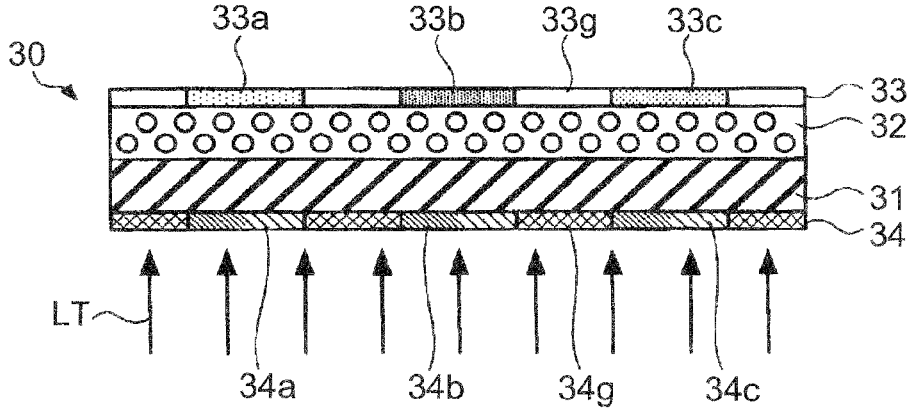
Figure 3D:
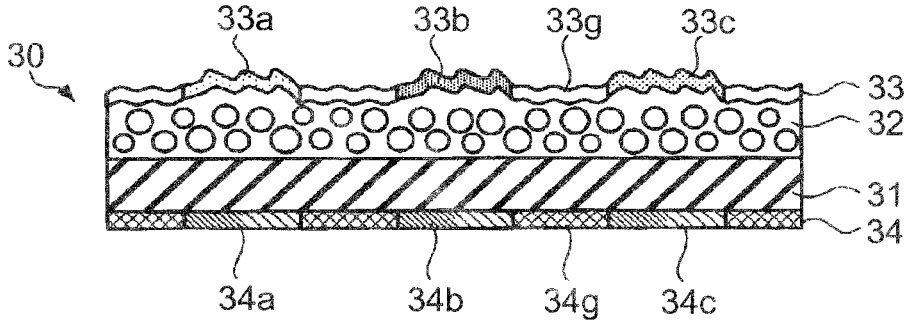

Next, in the light irradiation and heating processing (Step S104), as shown in FIG. 3C, the specific image 34 is evenly irradiated with light LT from a back face side of the thermal expansion sheet 30, the light LT including a wavelength of infrared light. Accordingly, at the dark portions and the light portions of the monochrome grayscale images which constitute the specific image 34 formed on the back face of the thermal expansion sheet 30, thermal energy in accordance with their respective densities is generated, and the microcapsules included in the corresponding regions in the thermal expansion layer 32 are heated and expanded (foamed), so that the thermal expansion layer 32 is raised. As described above, in each of the image regions 34*a* to 34*c* corresponding to the designs 33*a* to 33*c* for the dog image and the mountain images, dark portions and light portions are arranged with predetermined densities so as to express or reproduce a texture of a touch and/or a stroke of a brush of the oil painting style drawn by laying on paint thickly, for example. Accordingly, as shown in FIG. 3D, on the front face of the thermal expansion sheet 30 after expansion of the thermal expansion layer 32, the uneven patterns having brushstrokes and/or raised parts are formed so as to correspond to the texture of a touch and/or a stroke of a brush of the desired painting style. In addition, in the image region 34*g* corresponding to the background image part 33*g*, dark portions and the light portions are arranged with predetermined densities so as to express or reproduce the texture of a canvas. Accordingly, as shown in FIG. 3D, on the front face of the thermal expansion sheet 30 after expansion of the thermal expansion layer 32, the uneven pattern having predetermined coarseness and/or raised parts is formed so as to correspond to the texture of a canvas.

In the above, with reference to FIGS. 1 to 3D, it is described with respect to the embodiment, the image data generation processing (Step S101), the front face image formation processing (Step S102), the back face image formation processing (Step S103) and the light irradiation and heating processing (Step S104) are performed in the order named. However, the order of the processing is not limited thereto. That is, first, the image data of the colored image 33 (the front face image data) and the image data of the specific image 34 (the back face image data), which corresponds to the colored image 33, are prepared (generated) in the image data generation processing. However, it does not matter which of the front face image formation processing (Step S102) to form the colored image (front face image) and the back face image formation processing (Step S103) to form the specific image 34 (back face image) is performed first. That is, in the printing surface processing method of the present invention, the order of the image processing (forming) steps is not specified.

According to the embodiment, as shown in FIG. 3D, the surface shape of the thermal expansion sheet 30, on the front face of which the desired colored image 33 is printed, can be processed to have a plurality of kinds of textures depending on the designs of the colored image 33. For example, as shown in FIG. 2C, a piece can be created in a simple manner as if the designs 33*a* to 33*c* for the dog image and the mountain images of the colored image 33 are drawn with the texture of a touch and/or a stroke of a brush like paint being laid on thickly on the background image part 33*g* of the colored image with the texture of a canvas.

In the embodiment, of the colored image 33, the designs 33*a* to 33*c* for the dog image and the mountain images are expressed or reproduced with the texture for a touch and/or a stroke of a brush of the oil painting style drawn by laying on paint thickly, and the background image part 33*g* is expressed or reproduced with the texture of a canvas. However, the present invention is not limited thereto. That is, as long as a region of a colored image is expressed or reproduced with a first texture, and another region thereof is expressed or reproduced with a second texture, which is different from the first texture, the present invention can be applied thereto. For example, a colored image may be constituted of a background with a texture of the watercolor painting style and an object with a texture of the pastel painting style, the object being drawn on the background, or a colored image may be constituted of a background with a texture of the watercolor painting style and the colored pencil painting style being mixed and an object with the texture of the oil painting style, the object being drawn on the background. Accordingly, various painting styles, namely, various textures of touches and/or strokes of a brush of painting styles, can be combined in one piece, and accordingly various expression methods can be realized, which allows a user to think of and realize many ideas to create a piece.

As described above, according to the embodiment of the printing surface processing method of the present invention, a piece created by editing and processing an original image to have a desired painting style can be expressed or reproduced with a unique texture of the painting style in a simple manner.

<Printing Surface Processing Apparatus>

Next, a printing surface processing apparatus which can realize the above-described printing surface processing method is described.

Figure 4A:
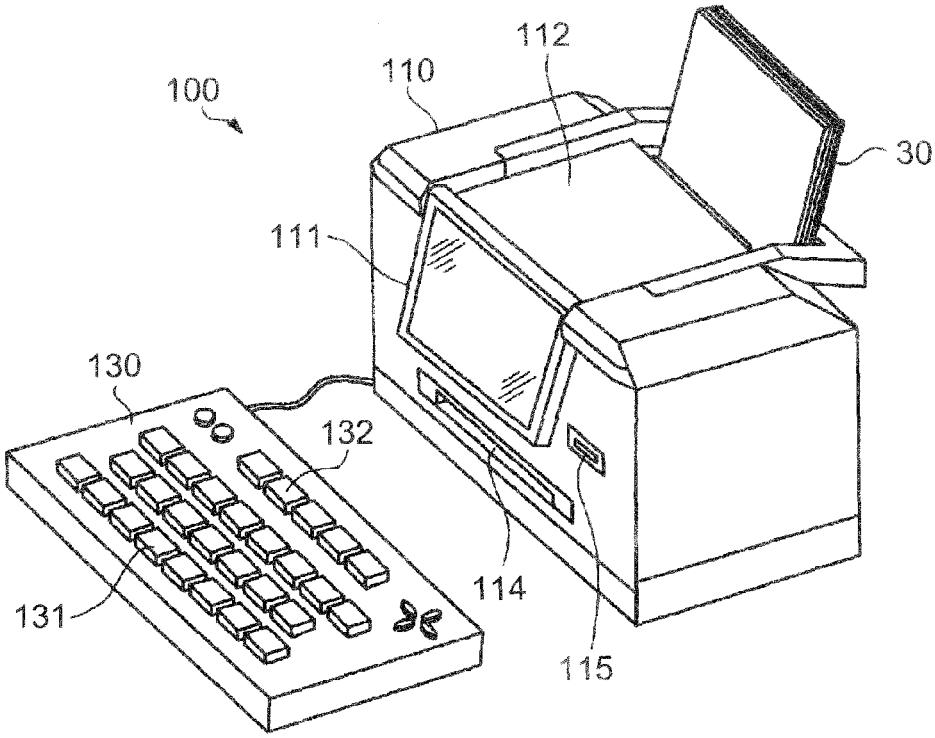
FIGS. 4A and 4B are illustrations schematically showing an example of a configuration of a printing apparatus applied to a printing surface processing apparatus of the present invention.
Figure 4B:
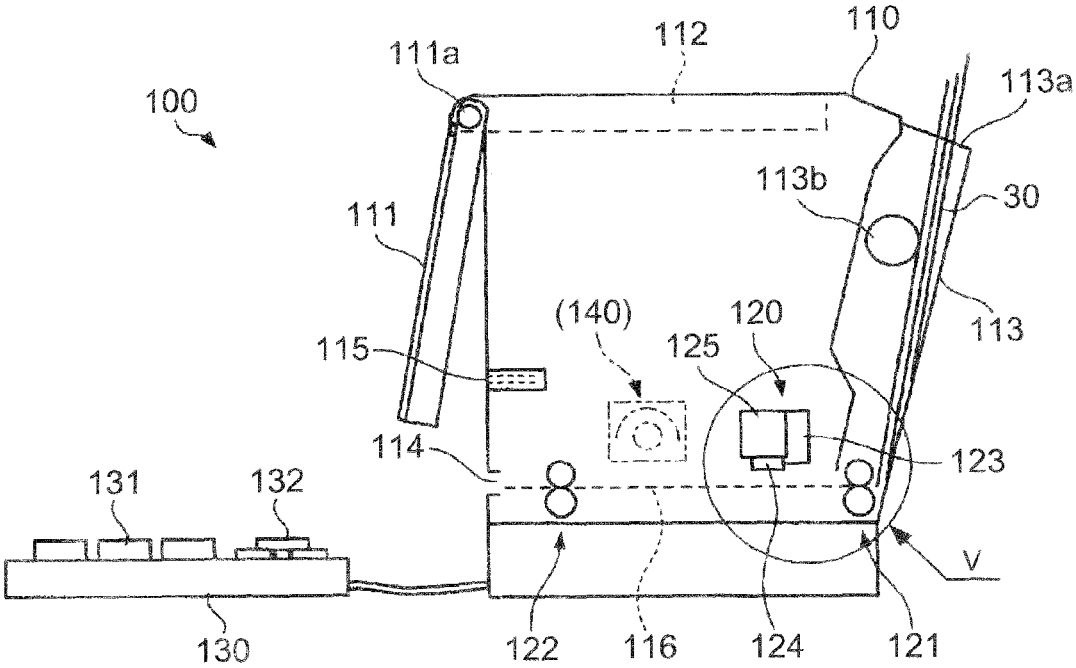
Figure 5:
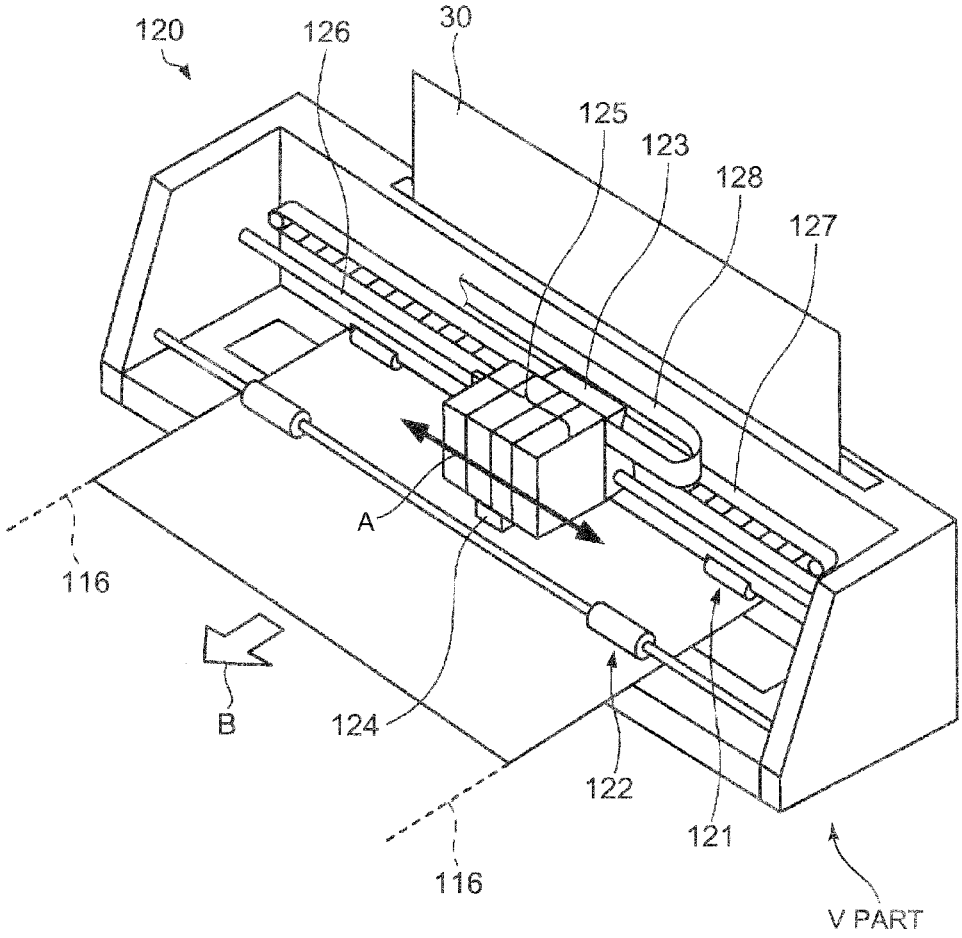
FIG. 5 is an illustration schematically showing an example of a configuration of a printing mechanism unit of the printing apparatus applied to the embodiment.

FIGS. 4A and 4B are illustrations schematically showing an example of a configuration of a printing apparatus applied to the printing surface processing apparatus of the present invention. More specifically, FIG. 4A is a perspective view schematically showing a configuration of the printing apparatus applied to the embodiment, and FIG. 4B is a cross-sectional view schematically showing an internal configuration of the printing apparatus applied to the embodiment. FIG. 5 is an illustration schematically showing an example of a configuration of a printing mechanism unit of the printing apparatus applied to the embodiment. More specifically, FIG. 5 is a perspective view showing a V part shown in FIG. 4B in detail.

Of the printing surface processing method (shown in FIG. 1), at least the image data generation processing (Step S101), the front face image formation processing (Step S102) and the back face image formation processing (Step S103) can be performed by a printing apparatus 100 shown in FIGS. 4A and 4B. The printing apparatus 100 applied to the embodiment is, for example, an inkjet system printer having a word processor function, and, to be specific, includes an apparatus main body 110 and a keyboard 130 as shown in FIGS. 4A and 4B.

Figure 6:
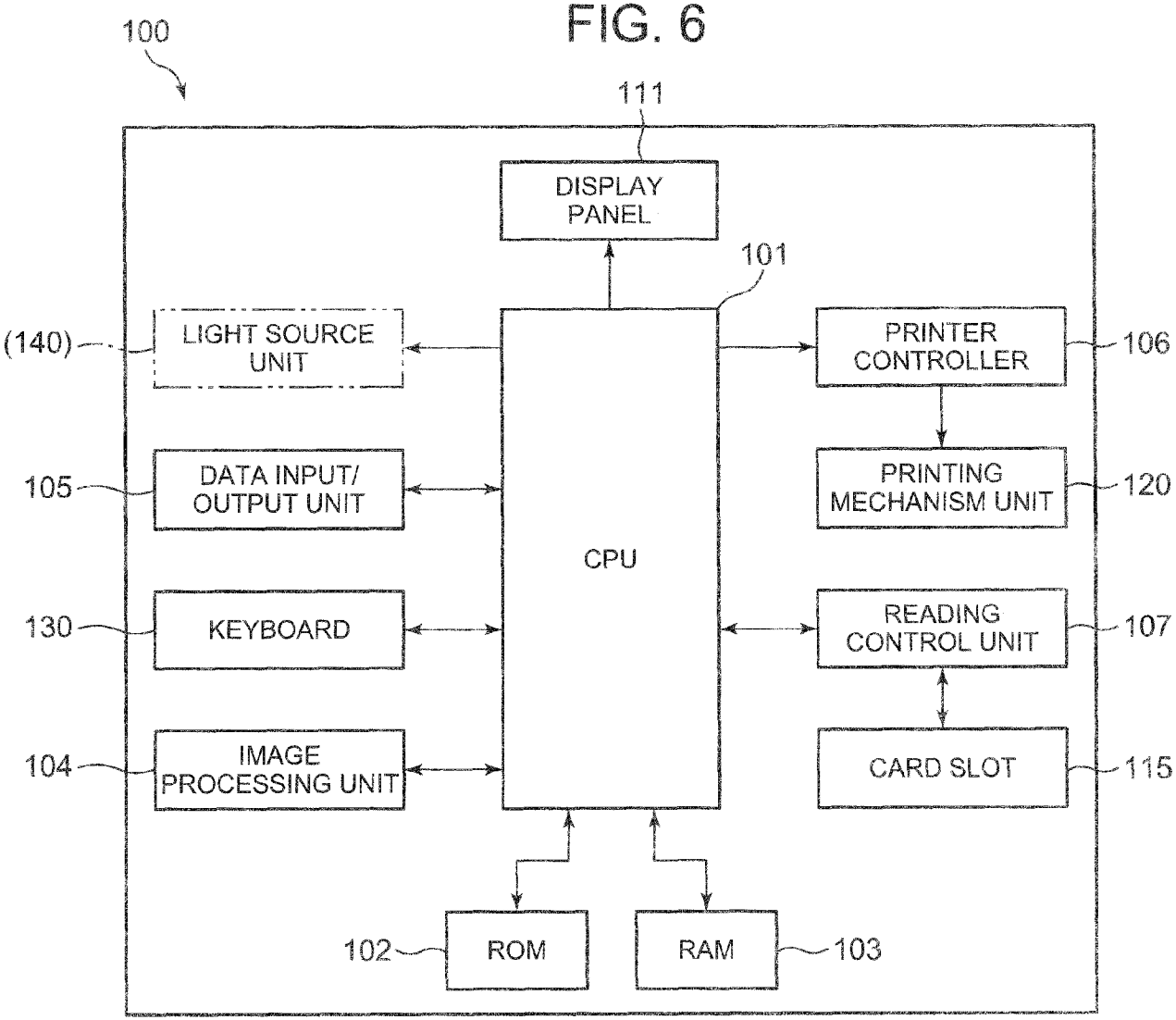
FIG. 6 is a block diagram showing examples of functions of the printing apparatus applied to the embodiment.

As shown in FIGS. 4A and 4B, the apparatus main body 110 includes a box-type casing, a display panel 111, a display panel housing unit 112, a paper feeding tray 113, a paper exit 114, a card slot 115, a printing mechanism unit 120 (shown in FIG. 5) and a control unit (shown in FIG. 6).

The display panel 111 is constituted of a liquid crystal display panel or the like, and attached to the apparatus main body 110 with a hinge unit 111*a* as a shaft to rotate with respect to the apparatus main body 110. The hinge unit 111*a* is disposed on one face of the display panel 111. The display panel 111 displays thereon a menu screen necessary for showing data inputted from the keyboard 130 and for performing various settings, various images such as pictures captured via a memory card, various data needed by the printing apparatus 100, and the like. The display panel housing unit 112 is disposed on the upper face part (the upper face in FIGS. 4A and 4B) of the apparatus main body 110, and when the printing apparatus 100 is not in use, rotates and houses the display panel 111.

The paper feeding tray 113 is disposed on the rear face part of the apparatus main body 110 (the right side in FIG. 4B). Thermal expansion sheets 30, described above, are housed one by one or together in the paper feeding tray 113 from an opening part 113*a* provided at the upper part of the paper feeding tray 113. In the paper feeding tray 113, a pickup roller 113*b* is disposed so that the thermal expansion sheets 30 housed in the paper feeding tray 113 are sent out to the printing mechanism unit 120 in the apparatus main body 110 one by one.

The paper exit 114 is provided at the lower part of the apparatus main body 110 (the left side in FIG. 4B), and ejects a thermal expansion sheet 30 on which a predetermined image (or images) is printed by the printing mechanism unit 120 of the apparatus main body 110 to the outside of the apparatus main body 110. The card slot 115 is provided at the front face of the apparatus main body 110. When a memory card (not shown) is inserted into the card slot 115, image data and the like is read/written from/into the memory card.

In the apparatus main body 110, as shown in FIG. 4B, a sheet conveyance path 116 is provided. The sheet conveyance path 116 carries and guides the thermal expansion sheet 30 sent out by the pickup roller 113*b* of the paper feeding tray 113. In the middle of the sheet conveyance path 116, the printing mechanism unit 12, which has an inkjet system or the like, is disposed. A pair of paper feeding rollers 121 and a pair of paper ejecting rollers 122 to carry thermal expansion sheets 30 are disposed on the paper feeding side (the right side in FIG. 4B) of the printing mechanism unit 120 and the paper ejecting side (the left side in FIG. 4B) thereof, respectively.

As shown in FIG. 5, the printing mechanism unit 120 includes a carriage 123 which moves in both directions (shuttle operation) indicated by an arrow A, the directions being at right angles to the sheet conveyance path 116. A print head 124 and an ink cartridge 125, which perform printing, are attached to the carriage 123. The ink cartridge 125 is constituted of cartridges respectively housing yellow ink, magenta ink, cyan ink and black ink, or a cartridge having ink rooms for the respective colors. The print head 124 having a nozzle to discharge ink of each color is connected to each cartridge or each ink room. With respect to the embodiment, as the black ink housed in the ink cartridge 125, a material having high photothermal conversion property (a high-photothermal conversion material), such as carbon black, is used.

The cartridge 123 is supported by a guide rail 126 so as to be able to perform the shuttle operation. By driving a drive belt 127 disposed in parallel to an extending direction of the guide rail 126, the print head 124 and the ink cartridge 125 attached to the cartridge 123 perform the shuttle operation in the same directions as those of the cartridge 123, namely, the directions at right angles to the sheet conveyance path 116 indicated by the arrow A.

The print head 124 receives print data and control signals sent from the control unit of the apparatus main body 110 via a flexible cable 128. As described above, a thermal expansion sheet 30 is intermittently carried by the pair of paper feeding rollers 121 and the pair of paper ejecting rollers 122 in a direction indicated by an arrow B shown in FIG. 5. During the intermittent stop of the conveyance of the thermal expansion sheet 30, the print head 124 performs the shuttle operation in accordance with the movement (drive) of the drive belt 127, and also discharges ink drops in a state in which the print head 124 comes close to the thermal expansion sheet 30, so that an image corresponding to the print data is printed on the front face or the back face of the thermal expansion sheet 30. By the intermittent conveyance of a thermal expansion sheet 30 and the printing by the print head 124 during the shuttle operation, a desired image (the colored image 33 or the specific image 34 described above) is formed (printed) on the whole front face or back face of the thermal expansion sheet 30. As shown in FIGS. 4A and 4B, the thermal expansion sheet 30 on which a predetermined image is printed by the printing mechanism unit 120 is ejected from the paper exit 114 located on the paper ejecting side of the sheet conveyance path 116 to the outside of the apparatus main body 110.

The keyboard 130 is disposed, as shown in FIG. 4A, in front of the front face of the apparatus main body 110 (the left side in FIG. 4A), and includes data input keys 131 and function keys 132. The data input keys 131 and the function keys 132 are necessary for inputting or editing document data and for performing various functions, such as printing, in the case where the apparatus main body 110 is used as a word processor, for example.

Next, the control unit disposed in the apparatus main body 110 of the printing apparatus 100 is described.

FIG. 6 is a block diagram showing examples of functions of the printing apparatus applied to the embodiment.

The printing apparatus 100 described above includes a central arithmetic circuit (central processing unit, CPU) 101, and a read only memory (ROM) 102, a random access memory (RAM) 103, an image processing unit 104, a data input/output unit 105, a printer controller 106, a reading control unit 107, the display panel 111 and the keyboard 130, which are connected to the CPU 101. The CPU 101, the ROM 102, the RAM 103, the image processing unit 104, the data input/output unit 105, the printer controller 106, and the reading control unit 107 constitute the control unit of the printing apparatus 100 applied to the embodiment.

The ROM 102 stores a system program related to control on operations of the printing apparatus 100. The CPU 101 sends command signals to the other function blocks (units and the like) which are connected to the CPU 101 in accordance with the system program so as to control the operations of the components (units and the like) of the printing apparatus 100. The RAM 103 temporarily stores various data, numerical values, and the like, which are generated by the CPU 101 and the like while the CPU 100 controls the operations of the printing apparatus 100.

The image processing unit 104 performs the image data generation processing (Step S101) of the printing surface processing method described above. That is, the image processing unit 104 generates image data (back face image data) of a specific image formed on the back face of a thermal expansion sheet 30 so as to express or reproduce a colored image captured from the outside of the apparatus main body 110 via the card slot 115 or the like and displayed on the display panel ill or stored in the ROM 103 or the like with a desired texture in a piece printed on the thermal expansion sheet 30. At the time, monochrome grayscale images, which form the specific image, are set by a user specifying or selecting a texture, which the user would like to realize, by using the display panel 111 and the keyboard 130, for example. The arrangement of dark portions and light portions of the grayscale images and the densities thereof may be appropriately adjusted by a user so that a desired texture of the user can be expressed or reproduced.

The data input/output unit 105 inputs/outputs printing commands related to image data from/to an external communication apparatus (not, shown), such as a laptop personal computer, a desktop personal computer or a tablet personal computer. The printer controller 106 is connected to the printing mechanism unit 120, and controls an ink discharge state of the print head 124 on the basis of the image data subjected to printing. The printer controller 106 controls the shuttle operation of the carriage 123 to which the print head 124 is attached, and also controls the movement (drive) of the pair of paper feeding rollers 121 and the pair of paper ejecting rollers 122 as to control the conveyance of thermal expansion sheets 30 to the paper ejecting side. The reading control unit 107 is connected to the card slot 115. The reading control unit 107 reads image data from a memory card (not shown) attached to the card slot 115, and sends the image data to the CPU 101 and the image processing unit 104.

According to the printing apparatus 100 having the above-described configuration, a colored image corresponding to the above-described image data can be formed (printed) on the front face of a thermal expansion sheet 30 supplied from the paper feeding tray 113, and a specific image corresponding to the above-described image data can be formed (printed) on the back face of the thermal expansion sheet 30. With respect to the embodiment, it is described that the printing apparatus 100 has a single-side printing function. That is, in the front face image formation processing (Step S102) of the printing surface processing method, a desired colored image is printed on the front face of a thermal expansion sheet 30 by the thermal expansion sheet 30 being fed in such a way that the front face thereof faces the print head 124. In addition, in the back face image formation processing (Step S103) thereof, a specific image is printed on the back face of the thermal expansion sheet 30 by the thermal expansion sheet 30 being reversed so as to be fed in such a way that the back face thereof faces the print head 124.

The printing apparatus applied to the printing surface processing apparatus of the present invention is not limited thereto. For example, the printing apparatus 100 may have sheet reversing mechanism units for double-side printing on the paper feeding side and the paper ejecting side of the printing mechanism unit 120 of the apparatus main body 110 shown in FIGS. 4B and 5. That is, it is possible, in the printing mechanism unit 120, to carry a thermal expansion sheet 30, on the front face (or the back face) of which printing has been performed, and which has been carried to the paper ejecting side, in a direction opposite to the direction indicated by the arrow B so as to return the thermal expansion sheet 30 to the paper feeding side; reverse the thermal expansion sheet 30 on the paper feeding side; perform printing on the back face (or the front face) of the thermal expansion sheet 30; and eject the thermal expansion sheet 30 from the paper exit 114. Accordingly, operations can be omitted, the operation to reverse a thermal expansion sheet 30, which has been ejected once after single-side printing, and to store the thermal expansion sheet 30 in the paper feeding tray 113 again.

Furthermore, with respect to the embodiment, it is described that the image processing unit 104 of the control unit of the printing apparatus 100 performs the image data generation processing (in particular, image data generation processing of a specific image) of the printing surface processing method. However, the present invention is not limited thereto. For example, an external communication apparatus, such as a personal computer, connected to the printing apparatus 100 via the data input/output unit 105 may perform the image data generation processing, and send image data of a colored image (front face image data) and image data of a specific image (back face image data) to express or reproduce the colored image with a desired texture to the printing apparatus 100 so that the printing apparatus 100 forms (prints) the colored image and the specific image on a thermal expansion sheet 30.

Furthermore, with respect to the embodiment, it is described that the printing apparatus 100 performs the image data generation processing (Step S101), the front face image formation processing (Step 2) and the back face image formation processing (Step S103) of the printing surface processing method. However, the present invention is not limited thereto. For example, as shown in FIG. 4B by a two-dot chain line, a light source unit (thermal energy application unit) 140, such as a halogen lamp, may be disposed above or under the sheet conveyance path 116 (or a thermal expansion sheet 30) on the paper ejecting side of the printing mechanism unit 120. The light source unit 140 emits a predetermined amount of light according to the conveyance of a thermal expansion sheet 30 on the basis of a command from the CPU 101, as shown in FIG. 6 by a two-dot chain line, for example.

With the configuration described above, a colored image is formed on the front face of a thermal expansion sheet 30 through the image data generation processing (Step S101), the front face image formation processing (Step S102) and the back face image formation processing (Step S103). In addition, the light irradiation and heating processing (Step S104) is performed on the thermal expansion sheet 30, on the back face of which a specific image is formed. In the light irradiation and heating processing, the specific image is evenly irradiated with light from the back face side of the thermal expansion sheet 30 so that the thermal expansion layer 32 of the thermal expansion sheet 30 is expanded to have a predetermined uneven pattern (or predetermined uneven patterns), and the surface shape of the thermal expansion sheet 30 is processed to have a predetermined texture (or predetermined textures). That is, with one printing apparatus 100, all the processing (steps) of the printing surface processing method can be performed.

As described above, according to the embodiment of the printing surface processing apparatus of the present invention, a piece created by editing and processing an original image to have a desired painting style can be expressed or reproduced with a unique texture of the painting style in a simple manner.

Having described and illustrated the principles of this application by reference to one preferred embodiment, it should be apparent that the preferred embodiment may be modified in arrangement and detail without departing from the principles disclosed herein and that it is intended that the application be construed as including all such modifications and variations insofar as they come within the spirit and scope of the subject matter disclosed herein.

What is claimed is:

1. A printing surface processing method comprising:

forming a substantially flat first printing image expressed with unevenness sense based on a touch and/or a stroke of a brush on a first face of a thermal expansion sheet in which a thermal expansion layer is formed on a first face of a base material sheet;

forming a second printing image constituted of a grayscale image made of a photothermal conversion material on a second face of the thermal expansion sheet, the grayscale image including a dark portion and a light portion with densities being set to form a substantially uneven shape on the first face of the thermal expansion sheet, the substantially uneven shape corresponding to unevenness image data, in which first unevenness image data to realize the unevenness sense of the first printing image and second unevenness image data to realize unevenness sense of fabric on which the first printing image is supposed to be formed are superposed; and applying thermal energy to the second printing image to expand the thermal expansion layer to form the substantially uneven shape in accordance with the second printing image on the first face of the thermal expansion sheet.

2. The printing surface processing method according to claim 1, wherein the second printing image is formed on the basis of the unevenness image data including the second unevenness image data which corresponds to a thread pattern expressing the fabric of a canvas so that the first printing image formed on the first face of the thermal expansion sheet is expressed by the uneven shape as if to be formed on the canvas.

3. The printing surface processing method according to claim 1, wherein the second printing image is formed on the whole second face of the thermal expansion sheet.

4. The printing surface processing method according to claim 1, wherein the thermal energy is applied to the second printing image by irradiation with light from a second face side of the thermal expansion sheet.

5. The printing surface processing method according to claim 4, wherein the light includes a wavelength of infrared light.

6. A printing surface processing apparatus comprising:

an image processing unit which generates first printing image data expressed with unevenness sense based on a touch and/or a stroke of a brush, and generates second printing image data converted into a grayscale image including a dark portion and a light portion with densities being set to correspond to unevenness image data, in which first unevenness image data to realize the unevenness sense of the first printing image data and second unevenness image data to realize unevenness sense of fabric on which a first printing image is supposed to be formed are superposed;

a printing mechanism unit which forms the first printing image on the basis of the first printing image data on a first face of a thermal expansion sheet in which a thermal expansion layer is formed on a first face of a base material sheet, and forms a second printing image on the basis of the second printing image data with a photothermal conversion material on a second face of the thermal expansion sheet; and a thermal energy application unit which applies thermal energy to the thermal expansion sheet, on the first face of which the first printing image is formed, and on the second face of which the second printing image is formed, to expand the thermal expansion layer to form a substantially uneven shape in accordance with the second printing image on the first face of the thermal expansion sheet.

7. The printing surface processing apparatus according to claim 6, wherein the second printing image is formed on the basis of the unevenness image data including the second unevenness image data which corresponds to a thread pattern expressing the fabric of a canvas so that the first printing image formed on the first face of the thermal expansion sheet is expressed by the uneven shape as if to be formed on the canvas.

8. The printing surface processing apparatus according to claim 6, wherein the second printing image is formed on the whole second face of the thermal expansion sheet.

9. The printing surface processing apparatus according to claim 6, wherein the thermal energy is applied to the second printing image by irradiation with light from a second face side of the thermal expansion sheet.

10. The printing surface processing apparatus according to claim 9, wherein the light includes a wavelength of infrared light.

* * * * *